United States Patent [19]

Venable

[11] 4,113,031

[45] Sep. 12, 1978

[54] POWER SHIFT MECHANISM FOR EARTH WORKING IMPLEMENTS

[75] Inventor: Phillip G. Venable, Orion, Ill.

[73] Assignee: J. I. Case Company, Racine, Wis.

[21] Appl. No.: 818,702

[22] Filed: Jul. 25, 1977

[51] Int. Cl.[2] ..... E02F 3/85

[52] U.S. Cl. ..... 172/667; 92/13.41; 403/4; 214/138 C; 172/476

[58] Field of Search ..... 172/40, 667, 663, 476; 214/138 C, 768; 280/460 A, 456 R, 456 A; 92/13.4, 13.41; 37/193; 403/3, 4

[56] References Cited

U.S. PATENT DOCUMENTS

| | | | |
|---|---|---|---|
| 1,904,922 | 4/1933 | Jungerson | 298/22 B |
| 3,155,250 | 11/1964 | French | 214/138 C |
| 3,436,099 | 4/1969 | Long | 214/138 C X |
| 3,554,601 | 1/1971 | Miskin | 298/22 J |
| 3,618,237 | 11/1971 | Davis | 172/40 |
| 4,020,745 | 5/1977 | Iijima | 214/138 C |
| 4,038,828 | 8/1977 | Schuck | 37/193 |
| 4,071,091 | 1/1978 | Morris | 92/13.41 |

*Primary Examiner*—Richard J. Johnson

*Attorney, Agent, or Firm*—Cullen, Sloman, Cantor, Grauer, Scott & Rutherford, P.C.

[57] ABSTRACT

The disclosed Power Shift Mechanism is adapted to laterally shift an earth working implement, such as a vertical plow, relative to a tractor or the like. In the disclosed embodiment, the plow is mounted on a slide bracket and the bracket is slideably mounted on a support frame. The shift mechanism includes a fluid operated piston-cylinder connected between the frame and a pivot link pivotally connected to the slide bracket. The pivot link may be rotated by the piston-cylinder to either of two positions and locked in place by releasable connectors. The piston-cylinder will then rotatably shift the pivot link or laterally shift the bracket and the earth working implement. The shift mechanism thus increases the effective stroke of the piston-cylinder and reduces the power requirements of the shift mechanism.

10 Claims, 6 Drawing Figures

POWER SHIFT MECHANISM FOR EARTH WORKING IMPLEMENTS

FIELD OF THE INVENTION

The present invention relates to side shift mechanisms for earth working implements, particularly vertical plows, cable laying plows and the like. More particularly, the present invention relates to improvements in power side shift mechanisms wherein the implement is mounted on a slide bracket which is laterally shifted by fluid operated piston-cylinders.

The prior art discloses a number of side shift mechanisms, including mechanisms such as disclosed herein which are powered by fluid operated piston-cylinders and more complex positive drive systems, such as rack and pinnion drives, etc. In the simplest form, the prior art power side shift mechanism includes a slide frame supported on the prime mover, a bracket slideably supported on the frame and the earth working implement supported on the bracket. A fluid operated piston-cylinder is interconnected between the frame and the bracket for lateral shifting of the bracket and the supported prime mover.

The prior art has however several disadvantages. First, with the impositive drive systems, the lateral shift of the implement is limited by the length and stroke of the piston-cylinder. Where a relatively large piston-cylinder is utilized, the piston-cylinder is expensive and the length of the cylinder portion limits the lateral shift of the slide bracket. Positive drive systems are relatively complex, expensive and more subject to failure, particularly in earth working implements. The power side shift mechanism of the present invention eliminates the problems of the prior art by utilizing a pivot link in combination with an impositive piston-cylinder drive as described herein below.

SUMMARY OF THE INVENTION

As described above, the power side shift mechanism of the present invention is particularly adapted to laterally shift a vertical plow, cable plow or other earth working implement mounted on a prime mover. In the disclosed embodiment, the prime mover includes a support frame and the implement is mounted on a slide bracket which is slideably supported on the support frame. The earth working implement may thus be shifted laterally relative to the prime mover by laterally sliding the bracket.

In the preferred embodiment, an extensible and retractable fluid operated piston-cylinder is mounted at one end to the support frame; the opposed end of the piston-cylinder is connected to a pivot link as described below. The pivot link is pivotally connected to the slide bracket, which includes three connections. The pivot link is pivotally connected to the center connection and the bracket includes two releasable connectors spaced on opposed sides of the pivot bracket-link connection. The pivot link has two mating releasable connectors defining, in combination with the bracket-link connection, a triangle. The piston-cylinder is pivotally connected between the releasable connectors, such that the piston-cylinder may be extended or retracted to rotate the pivot link about the pivotal connection with the bracket. When the pivot link is rotated toward the piston-cylinder and connected to the bracket, the piston-cylinder may be extended to fully extend the bracket, shifting the implement to one side of the frame. When the pivot link is rotated away from the piston-cylinder and secured, the piston-cylinder may be retracted to fully shift the implement to the opposed side of the frame. Adjustment of the piston-cylinder between these positions permits full lateral adjustment of the implement.

Thus, it can be seen, that the combination of the disclosed pivot link and the piston-cylinder provides full lateral shifting of the implement while reducing the length and stroke requirements of the piston-cylinder. In the disclosed embodiment, the stroke of the piston-cylinder may be approximately one-half the lateral shift of the implement, substantially reducing the power requirements and the expense of the piston-cylinder.

In the simplest form of the power side shift mechanism of the present invention, the pivot link is generally L-shaped having a central bite portion and two angularly related arms. The link is pivotally connected to the bracket adjacent the free end of one of the arms. The releasable connectors are defined at the center bite portion and adjacent the free end of the opposed arm. The piston-cylinder is then pivotally connected to the link between the bite portion and the releasable connection at the opposed arm free end. When the free end of the link is connected to the bracket adjacent the piston-cylinder, the piston-cylinder may be extended to shift the implement to the far end of the frame, away from the piston-cylinder. The releasable link connection may then be released, the pivot link rotated in a counterclockwise direction by the piston-cylinder and the bite portion connected to the farthest releasable connection on the bracket. The piston-cylinder may then be retracted to shift the earth working implement to the opposed end of the frame, adjacent the piston frame connection.

Other improvements in side shift mechanisms are also disclosed herein. For example, in the disclosed embodiment, the pivot link comprises two laterally spaced opposed L-shaped plates. The piston-cylinder includes a rod portion which extends between the plates and is pivotally connected to the plates by a pin connected to the opposed plates. Similarly, the bracket includes a pivot plate which extends between the L-shaped link plates and the link plates are pivotally connected to the bracket plate by a pivot pin. Other advantages and meritorious features of the present invention will be more fully understood from the description of the preferred embodiments, the appended claims and the drawing, a brief description of which follows.

DESCRIPTION OF THE PREFERRED EMBODIMENTS

Figure 1:
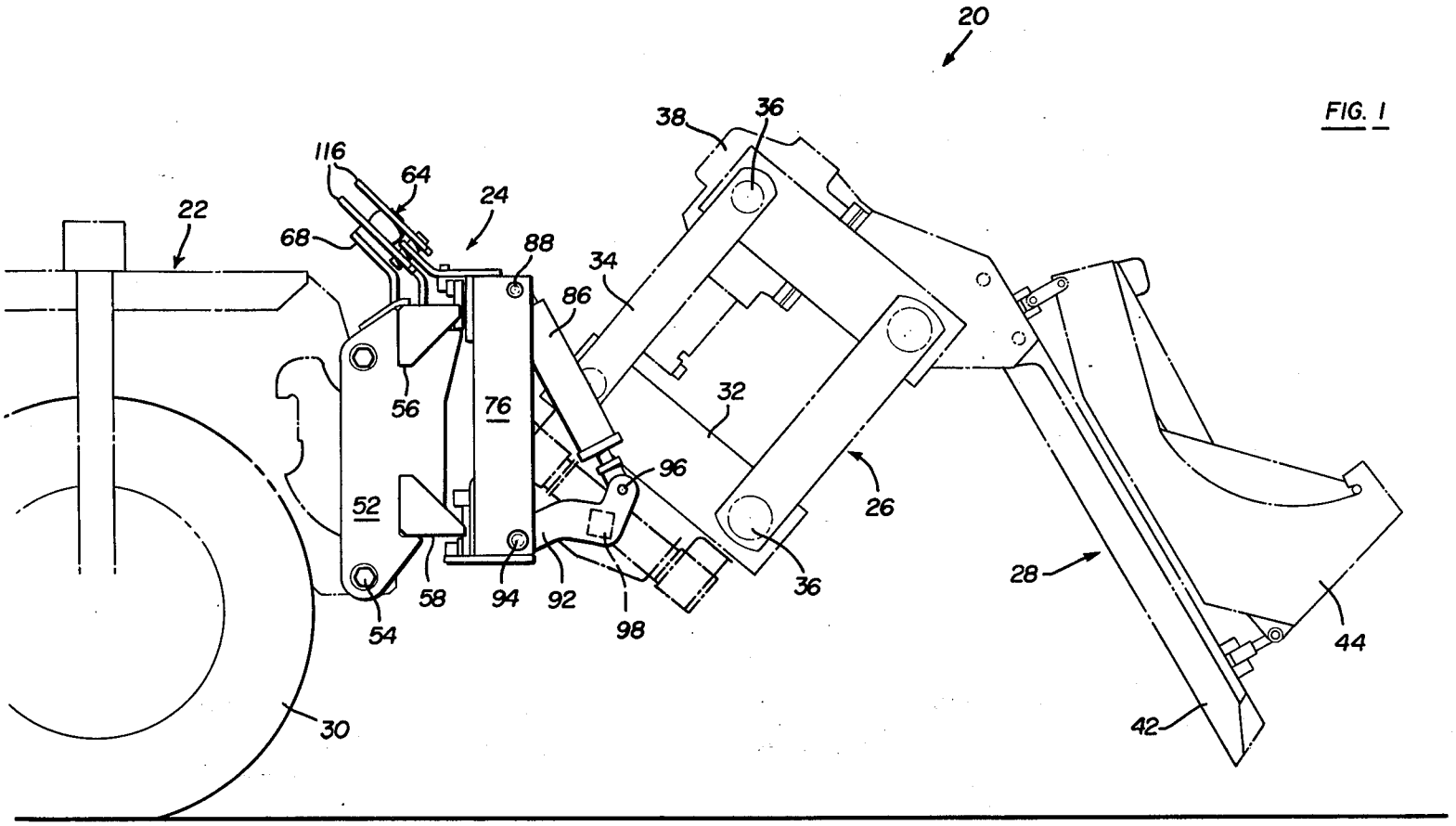
FIG. 1 is a partial side view of a cable laying plow having the power shift mechanism of the present invention.
Figure 2:
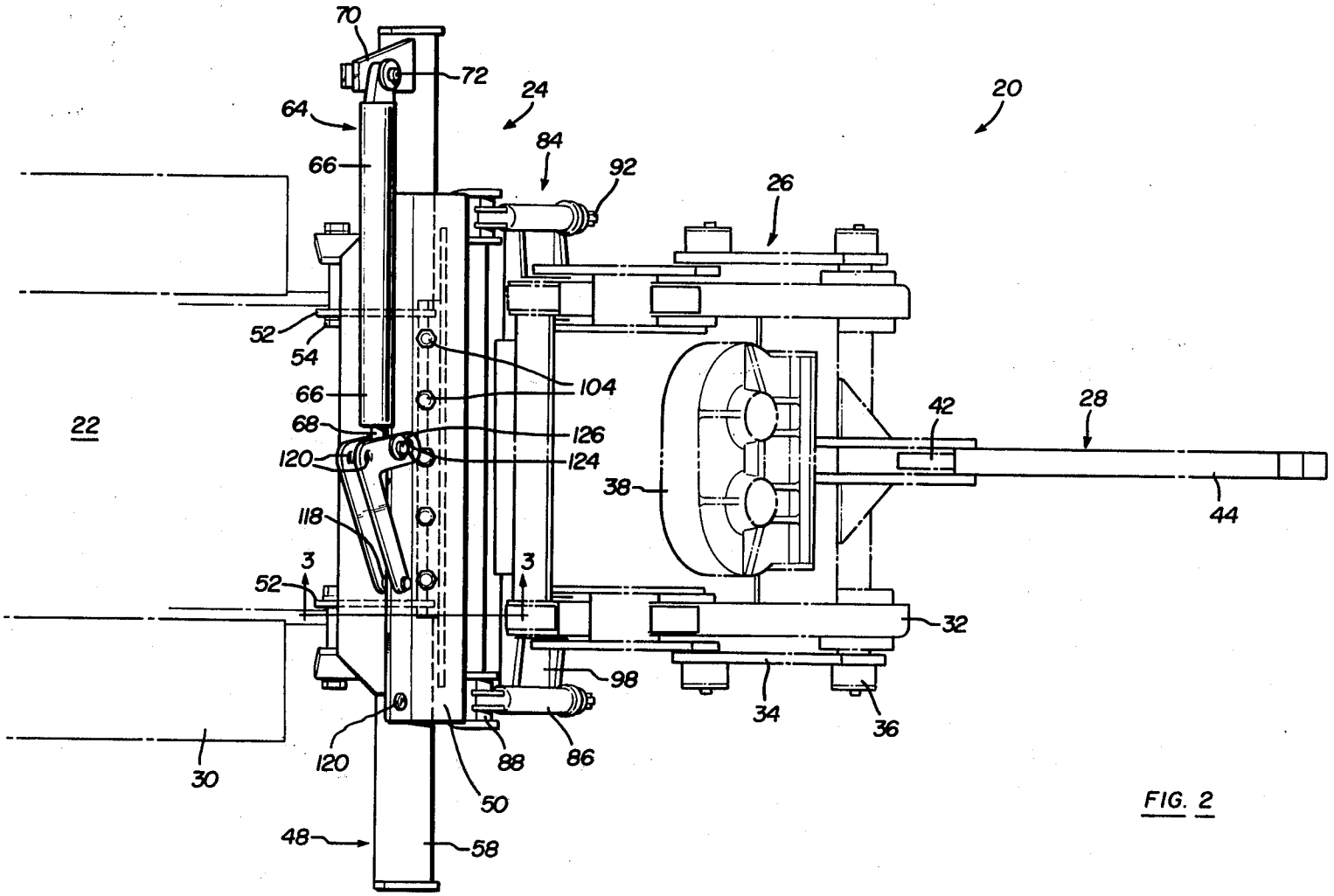
FIG. 2 is a top view of the cable laying plow disclosed in FIG. 1.

FIGS. 1 and 2 disclose a vibratory cable laying plow having one embodiment of the improved power side shift mechanism of this invention. It will be understood that the side shift mechanism may be used for various implements, including side shift backhoes and the like. Generally, the cable plow 20 shown in FIGS. 1 and 2 includes a prime mover 22, a slide bracket assembly 24, a plow frame assembly 26 and a plow assembly 28. In the disclosed embodiment, the prime mover 22 is a conventional tractor having wheels 30. It will be understood however that various prime movers may be used, including bulldozers and the like.

The disclosed embodiment of the cable plow includes a vibration isolating frame assembly 26 such as disclosed in U.S. Pat. Nos. 3,618,237 and 4,038,828 assigned to the assignee of the instant application. The frame assembly includes vertical and horizontal frame members 32 and 34, respectively, interconnected by resilient torsional bushings 36. A vibrator or shaker 38 is supported on the plow frame assembly 26 which vertically vibrates the generally vertical blade 42 of the plow assembly. The disclosed embodiment of the cable plow includes a multiple cable chute 42 on the trailing edge of the blade 42. The cable chute may be similar to the chute disclosed in U.S. Pat. No. 3,948,059 assigned to the assignee of the instant application.

It will be understood that the details of the prime mover 22, the plow frame assembly 26 and the plow assembly 28 are not critical to the side shift mechanism of the present invention and therefore have not been disclosed in detail herein. Further, the disclosures of the above referenced U.S. patents are incorporated herein for details of these elements. Finally, the power shift mechanism of the present invention will now be disclosed with reference to the cable laying plow assembly disclosed in FIGS. 1 and 2 as an example of an earth working implement, however the invention is not so limited.

Figure 3:
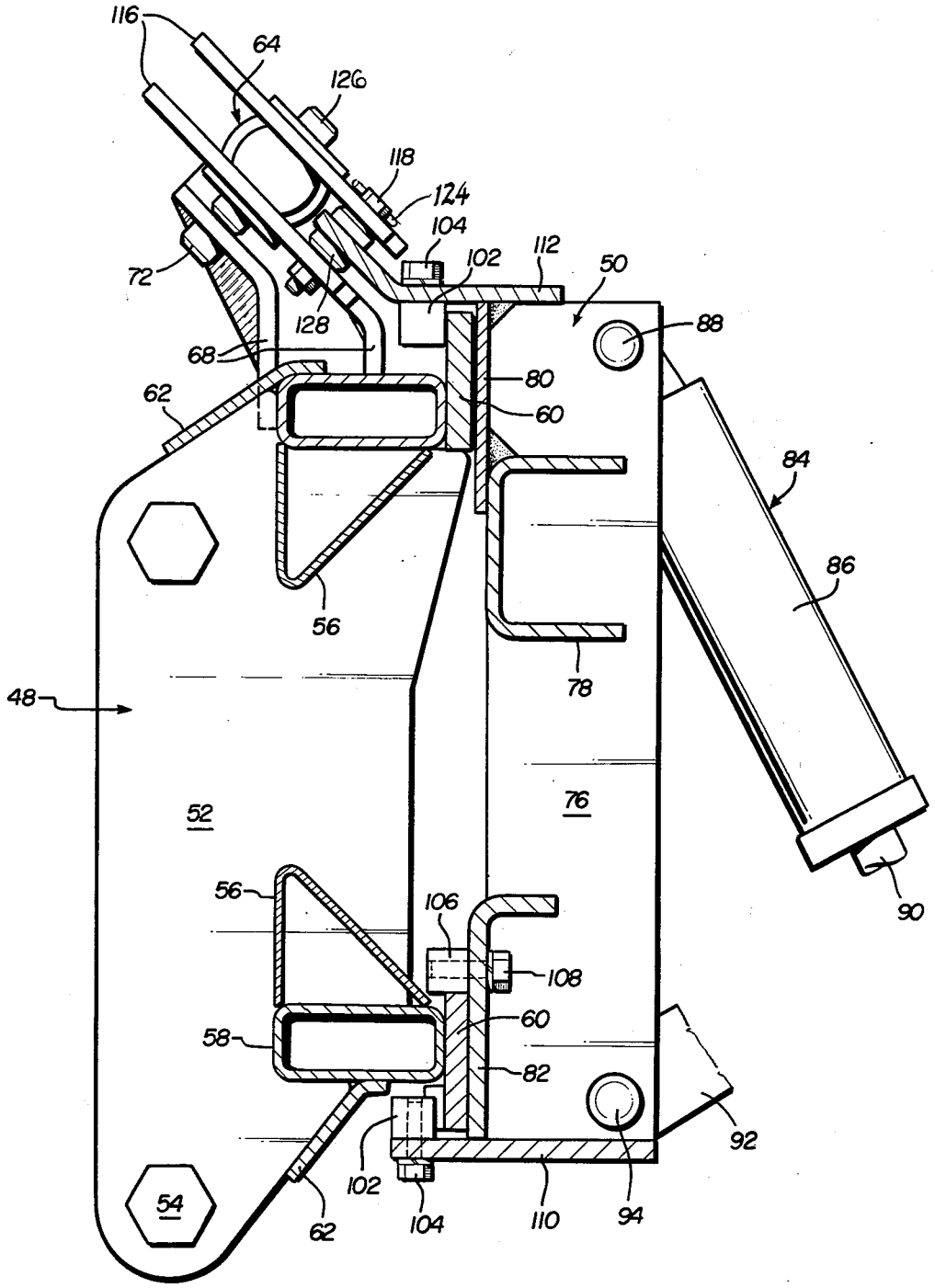
FIG. 3 is a side view of the power side shift mechanism disclosed in FIGS. 1 and 2, partially cross sectioned, in the direction of view arrows 3—3 in FIG. 2.

The power side shift mechanism of the present invention is incorporated in the slide bracket assembly 24 which includes a stationary frame assembly 48 mounted on the prime mover and a slide bracket assembly 50 upon which the plow frame assembly 26 and the cable plow assembly 28 are mounted. In the disclosed embodiment, the frame assembly 48 includes two vertical frame plates 52 which are bolted by bolts 54 or otherwise secured to the prime mover. As best shown in FIG. 3, the frame includes transverse channel-shaped support members which are welded in openings formed in the transverse plates 52. Rectangular tubular members 58 are welded to and supported by the channel-shaped members 56 and transverse slide rails 60 are welded or otherwise secured to the frame members 58. In the disclosed embodiment, reinforcement plates 62 are welded to the vertical plates 52 and the transverse frame members 58. As will be understood from the following description, the frame assembly 48 is intended to support the bracket assembly 50 on the prime mover and thereby the frame assembly 26 and the plow assembly 28 for lateral shifting of the plow assembly 28. The details of the construction including the arrangement of the channel sections, welding, etc. are not considered critical to the power side shift mechanism of this invention or its operation.

As best shown in FIG. 2, a hydraulic piston-cylinder 64 is pivotally connected at the free end of the cylinder portion 66 to brace members 70 by transverse pivot pin 72. The brace members 70 are welded or otherwise secured to frame member 58. The extensible and retractable rod portion 68 of the piston-cylinder is operably connected to the slide bracket assembly 50 as described hereinbelow.

As best shown in FIG. 3, the disclosed embodiment of the slide bracket includes generally parallel vertical channels 76, a transverse horizontal channel 78 which is welded or otherwise secured to the vertical channels and wear guide plates 80 and 82 welded or otherwise secured to the vertical channels. Hydraulic pitch cylinders 84 are connected to the bracket assembly to pitch the plow frame assembly 26 and plow assembly 28 out of the ground as shown in FIG. 1 or lower the plow blade 42 into the ground as described below. The hydraulic cylinder portions 86 of the pitch cylinders are pivotally connected by pins 88 to the vertical channels 76 adjacent the top of the channels as shown in FIGS. 1 and 3. The rod portions 90 are pivotally connected to the free ends of pitch links 92 by transverse pins 96. The opposed ends of the pitch links are pivotally connected to the lower ends of the vertical channel members 76 by transverse pins 94. It will be understood that the pivotal connections between the various members including pivot pins 72, 88, 94, etc. would normally include cotter pins or the like, not shown, to retain the pins against longitudinal movement. The pitch links are secured to the plow frame assembly 26 by transverse tubular frame members 98 which are welded or otherwise secured to the midportion of the links as shown in FIGS. 1 and 2.

The plow blade 42 may thus be lowered into the ground by extending piston-cylinders 84, which rotates pitch links 92 and plow frame 26 in a clockwise direction as shown in FIG. 1. Alternately, the plow blade 42 may be raised for transport as shown in FIG. 1 by retracting the pitch cylinders, rotating the pitch links 92 in a counterclockwise direction.

The slide bracket assembly 50 is supported on guide rails 60 for sliding movement by removable guides. As shown in FIGS. 2 and 3, the bracket assembly includes vertical guide bars 102 which engage one face of guide rails 60. The lower guide bar is bolted to plate 110 which may be welded or otherwise secured to the vertical channel members 76. The upper guide bar is bolted to pivot plate 112, which is welded or otherwise secured to vertical channels 76 and wear plate 80. The bracket assembly also includes a transverse horizontal guide bar 106 which is bolted by bolts 108 to the lower wear guide 82 as shown in FIG. 3. The guide bars 102 and 106 may be formed from wear resistant steel and are removable to permit disassembly of the bracket assembly 50 from the frame assembly 48. In the disclosed embodiment, the vertical and horizontal guide bars slidingly support the bracket assembly 50 on the guide rails 60, permitting transverse movement of the bracket and plow assembly which is referred to as side shifting in earth working implements.

Figure 5:
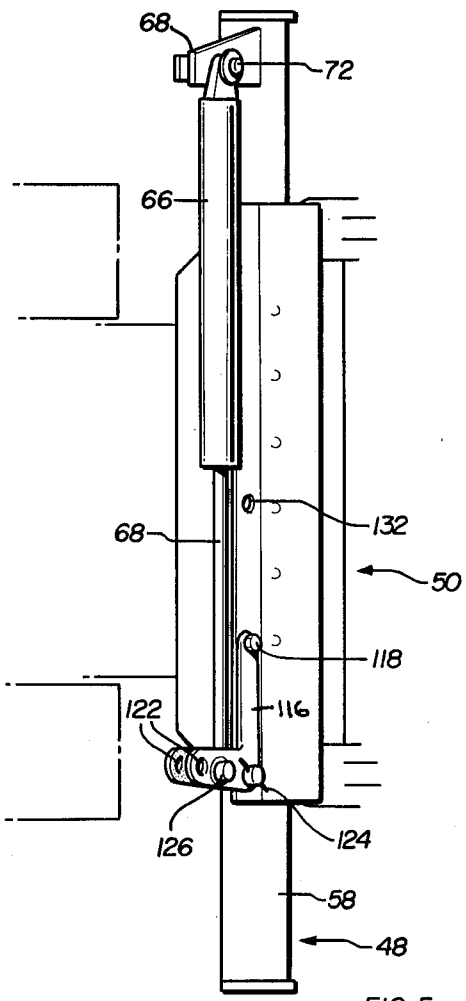
FIG. 5 is a top elevation of the side shift mechanism, similar to FIG. 4, with the pivot link rotated counterclockwise.

As described above, the rod portion 68 of side shift piston-cylinder 64 is operably connected to the slide bracket 50. In the preferred embodiment of the disclosed side shift mechanism, the piston-cylinder is pivotally connected to a pivot link which is comprised of two L-shaped plates 116. As shown, the plates are generally parallel and pivotally connected to the slide bracket by a relatively permanent pivotal connection defined by bolt and nut 118. The pivot link also includes two releasable or quick connectors which are defined by apertures 120 at the bite portion of the L-shaped link (see FIG. 2) and apertures 122 adjacent the free end of the link (see FIGS. 5 and 6). The pivot plate 112 has mating apertures or connectors 130 and 132 for receiving the releasable connectors of the pivot link as described more fully hereinbelow. In the preferred embodiment, a quick connect fastener is used to retain the link in either of the two alternate positions. In the disclosed embodiment, the releasable connector is a T-shaped pin which is received through the apertures in the pivot link and plate. A bearing 128 is retained in the pivot plate apertures 130 and 132 for receiving the T-shaped connector. Finally, the rod end 68 of the piston-cylinder is pivotally connected between the releasable pivot link connectors, 120 and 122, respectively, by a lock pin 126.

The operation of the side shift mechanism is illustrated in FIGS. 2 and 4 to 6, as follows. In FIG. 2, the slide bracket 50 and therefore the cable laying plow 28 is in the midposition. If the piston rod 68 of the side shift piston-cylinder is fully extended, the implement will be shifted fully to the left as viewed in FIG. 4. If, instead, the releasable T-shaped connector 124 is removed and the piston rod 60 is extended, the pivot link 116 will be rotated in a counterclockwise direction as viewed in FIG. 5. The releasable connector may then be secured through the apertures 120 in the bite portion of the link and the outside plate connector 130 as viewed in FIG. 5. If, the piston rod 68 is then retracted, the slide bracket assembly and the supported implement will be shifted fully to the right as viewed in FIG. 6. Thus, the cable plow may be side or laterally shifted from one side of the frame to the other using a hydraulic piston-cylinder having approximately one-half the stroke of a piston-cylinder connected directly to the slide bracket. The disclosed side shift mechanism thus results in a substantial saving in cost and power requirements.

Figure 6:
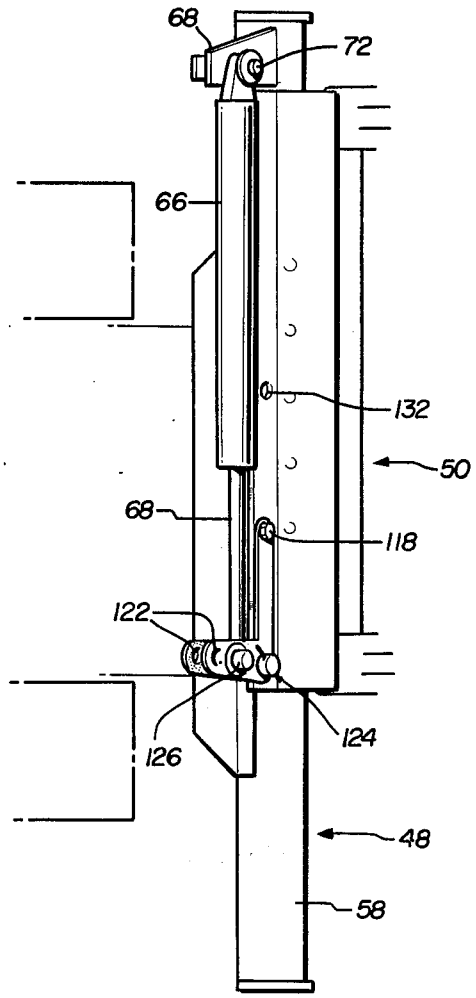
FIG. 6 is a top elevation of the side shift mechanism, similar to FIGS. 4 and 5, with the implement laterally shifted fully to the right.
Figure 4:
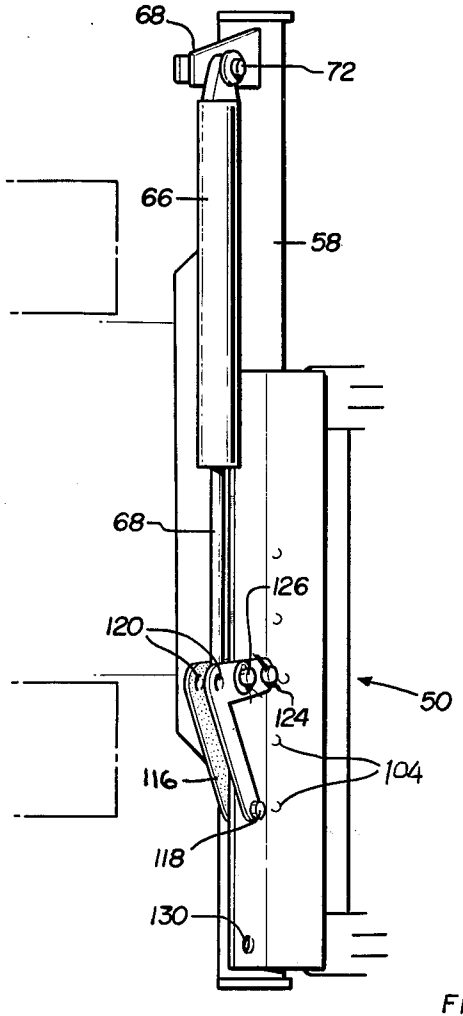
FIG. 4 is a top elevation of the side shift mechanism shown in FIG. 3 with the implement shifted to the left.

Thus, the piston-cylinder 64 may be extended or retracted to rotatably shift the pivot link 116 or the slide bracket 50. The quick connect T-shaped pin is easily inserted in either of the releasable connectors to retain the L-shaped link in the desired position. When the link is rotated to align the aperture 120 at the bite portion of the link with the outside connector 130 of the slide bracket, the piston-cylinder may be retracted to locate the implement to the right as shown in FIG. 6. When the free end of the pivot link is rotated in a clockwise direction to align aperture 122 of the link with connector 132 of the pivot plate, the piston-cylinder may be extended to locate the implement fully to the left as shown in FIG. 4. It will be understood that the implement and the slide bracket may be easily located in any intermediate position by extending and retracting the piston-cylinder.

It will be understood by those skilled in the art that various modifications may be made to the details of the disclosed power side shift mechanism without departing from the purview of the appended claims. For example, the pivot link may be triangular in shape as the three connections 118, 120 and 122 define a triangle in spaced relation. The parallel spaced plates 116 provide a stronger connection between the piston-cylinder and the bracket, particularly where the pivot plate 112 is received between the link plates 116 as shown in FIG. 3. A single link plate may however be utilized.

I claim:

1. A power shift means for a ground working implement slideably mounted on a prime mover, comprising: a frame support mounted on said prime mover having a laterally extending slide rail, an implement support bracket slideably mounted on said frame rail, said ground working implement mounted on said bracket for lateral movement relative to said prime mover, said power shift means including an extensible and retractable fluid operated piston-cylinder operably connected at one end to said frame support, a generally L-shaped link having a pair of angularly related arms and a central curved bite portion, said link pivotally connected adjacent one end to said laterally slideable bracket, said bracket having releasable connectors spaced on opposed sides of said pivotal bracket-link connection and said link having mating releasable connectors adjacent the opposed end of said link and said central bite portion, and the opposed end of said piston-cylinder pivotally connected to said link between said opposed end and said central bite portion, whereby said implement support bracket may be laterally shifted relative to said prime mcver by said power shift means, said power shift means operable to laterally shift said slide bracket or rotate said link about said pivotal bracket-link connection, the lateral position of said bracket being dependant upon which of said releasable link connectors are connected to said bracket.

2. The power shift means defined in claim 1, characterized in that said releasable connectors comprise aligned mating holes in said link and said bracket and retainer pins being receivable through said aligned link and bracket holes.

3. The power shift means defined in claim 1, characterized in that said link comprises a pair of spaced generally parallel opposed L-shaped plates and said piston-cylinder having a piston rod extending between said plates pivotally connected to said link by a pivot pin extending through said plates.

4. The power shift means defined in claim 3, characterized in that said bracket has a pivot plate disposed between said spaced link plates having three spaced apertures and said link plate pivotally secured to the center aperture of said pivot plate by a pivot pin and said link rotatable about said pivot pin for releasable securement to either of said releasable connectors.

5. A generally vertical plow-like earth working implement mounted on a prime mover, said prime mover having a support frame, said implement mounted on a slide bracket and said bracket slideably mounted on said support frame permitting lateral shifting of said earth working implement relative to said prime mover, the improvement comprising:

an extensible and retractable fluid operated piston-cylinder mounted at one end to said support frame, the opposed end of said piston-cylinder connected to a pivot link, said pivot link pivotally connected to said slide bracket, said slide bracket having releasable connectors spaced on opposed sides of said bracket-link pivotal connection and said link having two mating releasable connectors, said pivotal bracket-link connection and said releasable link connectors defining a triangle, and said piston-cylinder pivotally connected to said link between said releasable link connectors, whereby said piston-cylinder may be extended or retracted to rotate said pivot link about said bracket-link pivotal connection and slideably shift said bracket and said earth working implement when one of said releasable link connectors is connected to said bracket.

6. The earth working implement defined in claim 5, characterized in that said pivot link is generally L-shaped having a central bite portion and two angularly related arms, said pivotal bracket-link connection and releasable connectors defined adjacent the free ends of said arms and said central bite portion.

7. The earth working implement defined in claim 6, characterized in that said pivot link comprises two laterally spaced, opposed generally parallel L-shaped link plates and said releasable connectors each comprising aligned holes in said plates which receive connector pins alternately retaining said link to said slide bracket.

8. The earth working implement defined in claim 7, characterized in that said bracket has a pivot plate extending between said link plates having three spaced apertures and said link pivotally connected to the center aperture of said pivot plate.

9. The earth working implement defined in claim 6, characterized in that said link is pivotally connected to said slide bracket adjacent the free end of one of said arms, said releasable connectors located adjacent the free end of the opposed arm and said central bite portion and said piston-cylinder connected to said link between said releasable connectors.

10. The earth working implement defined in claim 5, characterized in that said piston-cylinder is connected to said frame adjacent one end of said frame and the farthest releasable bracket connector located adjacent the opposite end of said slide bracket, permitting full extension and retraction of said bracket relative to said frame.

* * * * *